United States Patent [19]

Hirabayashi et al.

[11] Patent Number: 4,802,408

[45] Date of Patent: Feb. 7, 1989

[54] COMPACTING APPARATUS OF ROLLED PLASTIC FILMS

[75] Inventors: Akio Hirabayashi, Saitama; Katsuaki Kaneko, Hasuda; Yoshitake Okazaki, Ageo, all of Japan

[73] Assignee: Shin-Etsu Polymer Co., Ltd., Tokyo, Japan

[21] Appl. No.: 180,900

[22] Filed: Apr. 13, 1988

[51] Int. Cl.[4] ..... B30B 9/00

[52] U.S. Cl. ..... 100/90; 100/214; 100/218

[58] Field of Search ..... 100/90, 100, 214, 218, 100/211

[56] References Cited

U.S. PATENT DOCUMENTS

| | | | |
|---|---|---|---|
| 3,029,723 | 4/1962 | Schweer | 100/90 X |
| 3,548,739 | 12/1970 | Glasson | 100/218 X |
| 3,958,392 | 5/1976 | Beninger | 100/223 X |
| 4,438,690 | 3/1984 | von Allworden | 100/211 X |
| 4,509,417 | 4/1985 | Brandt et al. | 100/90 |

*Primary Examiner*—Harvey C. Hornsby
*Assistant Examiner*—K. L. O'Leary
*Attorney, Agent, or Firm*—Wenderoth, Lind & Ponack

[57] ABSTRACT

The apparatus serves to squeeze out air bubbles entrained between layers of rolled plastic films by pneumatically compacting so as to decrease the cloudiness in the appearance of a transparent plastic film roll. The apparatus comprises a base shaft, a tiltable trough to receive and discharge film rolls, and a movable drum which envelopes the film rolls on the trough as engaged with the base shaft with air-tightness. The space containing the film rolls received on the trough are enclosed air-tightly by the drum and base shaft engaged together and pressurized by introducing compressed air to squeeze out air bubbles out of the film rolls and then the drum is disengaged from the base shaft followed by tilting of the trough to discharge the film rolls.

1 Claim, 2 Drawing Sheets

COMPACTING APPARATUS OF ROLLED PLASTIC FILMS

BACKGROUND OF THE INVENTION

The present invention relates to an apparatus for compacting rolled plastic films or, more particularly, to an apparatus which is used for pneumatically compacting a roll of plastic films from outside to exclude or squeeze out any air bubbles unavoidably entrained between layers of the film in the winding-up process of the roll so that the cloudiness in the appearance of the roll can be reduced to increase the value of the rolled plastic films as a commercial product.

The above mentioned phenomenon of air entrainment in a roll of plastic films is one of the serious problems in the manufacture of transparent plastic films which are produced without exception in the form of film rolls because rolls containing many air bubbles between layers of transparent plastic films exhibit cloudy appearance to greatly decrease the value as a commercial product. Although entrainment of air bubbles can be reduced to some extent by improvements in the winding-up process of the plastic films into rolls, no solution can be obtained for completely eliminating entrainment of air bubbles between layers of rolled plastic films. Accordingly, it is desirable to develop an efficient apparatus for excluding or squeezing out the air bubbles by compacting from outside of the plastic film roll after winding up. No information is available, however, for such an apparatus suitable for industrial use insofar as the inventors are aware.

SUMMARY OF THE INVENTION

The present invention accordingly has an object to provide an apparatus for compacting a roll of plastic films from outside pneumatically in order to squeeze out any air bubbles entrained between layers of the plastic films. In particular, the invention has an object to provide such an apparatus on which a plural number of plastic film rolls can be treated simultaneously as a group.

Thus, the apparatus of the invention for pneumatically compacting a roll of plastic films comprises:

(a) a base stand having an elongated plan;

(b) a hollow cylindrical base shaft fixedly mounted in a horizontal disposition on or above the base stand along the longitudinal direction of the base stand and connected at one end to a means for air supply and evacuation, the other end being open;

(c) a trough for receiving rolls of plastic films pivotally connected to the base shaft at one end in a tiltable manner in the circumferential direction, the other end thereof extending toward the longitudinal direction of the base stand;

(d) an elongated cylindrical drum closed at one end remote from the base shaft and mounted above the base stand in a movable manner along the longitudinal direction of the base stand to envelope the trough when moved toward the base shaft; and (e) a means for fastening the open end of the elongated cylindrical drum to the open end of the base shaft and air-tightly connecting the same together.

DETAILED DESCRIPTION OF THE PREFERRED EMBODIMENTS

Figure 1:
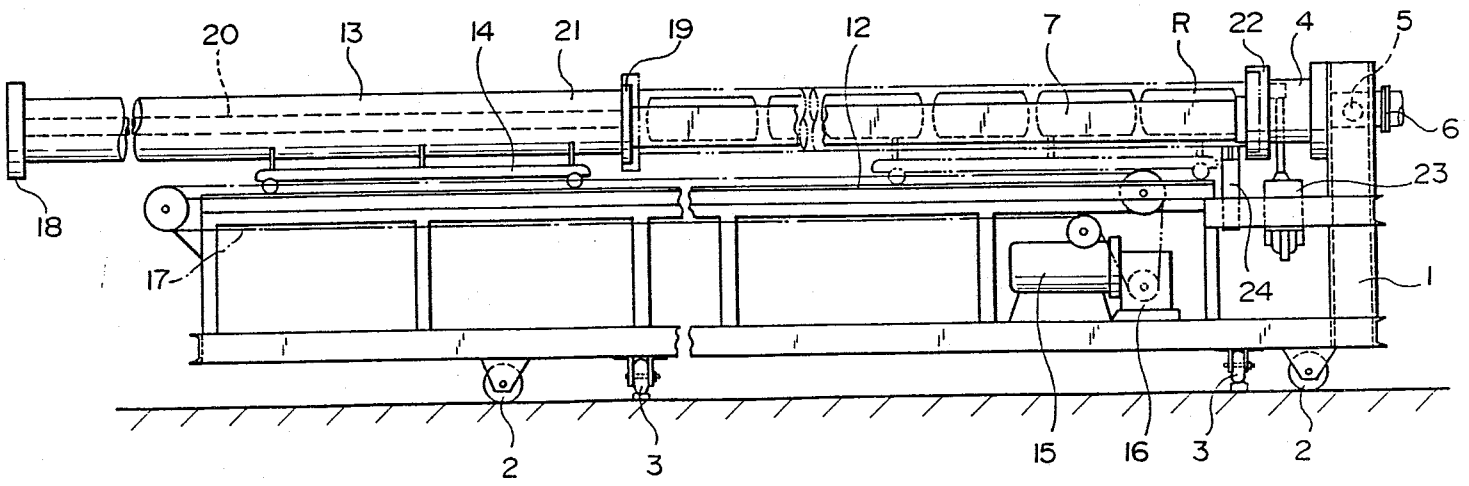
FIG. 1 is a side elevational view of the apparatus.

In the following, the apparatus of the present invention is described in more detail with reference to the accompanying drawing, which, however, should not be construed to limit the scope of the invention in any way.

In the figures of the accompanying drawing, the base stand 1 having an elongated rectangular plan is provided with two sets of wheels 2,2 and 3,3, by means of which the base stand 1 can be moved in the longitudinal direction and transverse direction, respectively. A cylindrical base shaft 4 is fixedly mounted above the base stand 1 lying in the longitudinal direction of the base stand 1. The base shaft 4 is provided inside with a mechanism for switching air supply into and evacuation from the base shaft 4 (not shown in the figure). The base shaft 4 is connected at one end (right-hand end on FIG. 1) to an air supply duct 5 and evacuation duct 6 while the other end is open. A tiltable trough 7 is positioned in such a disposition that the bottom thereof is in parallel to but aside the axial line of the base shaft 4 at a side toward the viewer of FIG. 1. The trough 7 is pivotally connected at the pivotal axis 8 in parallel to the axial line of the base shaft 4 in such a manner that the trough 7 can be tilted within a range of 90° angle around the axis 8 (see FIG. 3) to receive and discharge film rolls. The trough 7 is formed of three parts including the bottom trough 9 having a rectangular cross section, a first side plate 10 at the discharge side of the rolled film, of which the upper part is upright and the lower part is aslant to make the width of the trough 7 wider in the upper part than at the bottom trough 9, and a second side plate 11 at the receiving side of the trough 7, which is aslant to make the width of the trough 7 wider in the upper part than in the bottom trough 9 with a further bent along about the center line to decrease the inclination of the plate in the upper half thereof. The upper periphery of the second side plate 11 is at a height lower than that of the first side plate 10. In this manner, each of the plastic film rolls is received at such a height that the axis of the roll is at a height some-what higher than the axis of the base shaft 4.

The base stand 1 is provided on the upper surface thereof with two rails 12,12 running in parallel symmetrically relative to the center line of the base stand 1. A wheeled cart 14 is mounted on these rails 12,12 so as to be movable in the right and left directions in FIG. 1 and a cylindrical drum 13 is supported by the cart 14. The wheeled cart 14 can be moved right and left on the rails 12,12 by means of the driving mechanism composed of an electric motor 15, transmission gear box 16 and chain 17. The cylindrical drum 13 is closed at one end with an end plate 18 which is provided at about the center inside with a supporting rod 20 horizontally extending to the open end 19 of the cylindrical drum 13 in a cantilever-like manner. The height of this supporting rod 20 is somewhat higher than the axis of the cylindrical drum 13. The drum wall 21 of the cylindrical drum 13 is coaxial with the base shaft 4 and, when the trough 7 is positioned to receive a roll of plastic films R, is at a position to envelope the outer surface of the roll R. The open end 19 of the cylindrical rod 13 has such a configuration and is at such a position that the open end 22 of the base shaft 4 can be inserted thereinto and withdrawn therefrom. When the open end 22 of the base shaft 4 is inserted into the open end 19 of the cylindrical drum 13, they are in contact with each other with air-tightness by a mechanism of a fluid pressure-operated lockring cylinder device 23. A tilting mechanism 24, which is composed of a fluid-pressure cylinder 25 and a wheeled pusher rod 26 held on the end of a plunger of the cylinder 25, serves to tilt the trough 7 in such a manner that the trough 7 can be tilted by an angle of 90° or smaller when the bottom trough 9 is pushed by the pusher rod 26 which is moved linearly by pressurizing the fluid-pressure cylinder 25.

Figure 2:
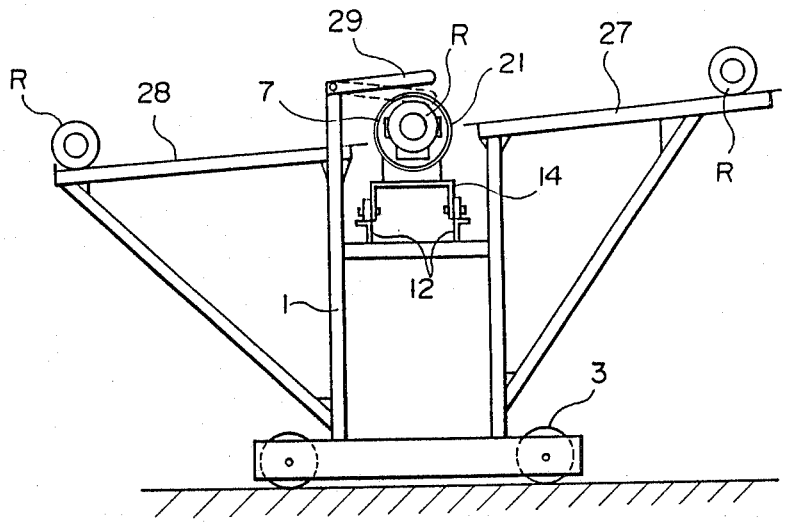
FIG. 2 is a cross sectional view of the apparatus as cut perpendicularly to the longitudinal direction of the core shaft.

As is illustrated in FIG. 2, a receiving table 27 and a discharge table 28 each having an inclination and supported by the base stand 1 are provided on the receiving side and discharge side, respectively, of the trough 7 so as to utilize gravity for the movement of a film roll toward and from the trough 7. A set of pivotally supported alignment-detecting arms 29 are provided in a swingable manner within a vertical plane above the discharge side of the base stand 1 in a lattice-like arrangement with a span to cover all of the film rolls R . . . to be aligned in a row.

In the following, a description is given on the movement of each of the above described parts. In FIG. 1, the starting position of the cylindrical drum 13 is shown by the solid lines and a plural number of film rolls R . . . each having an appropriate film width by cutting in and transferred from a film roll processing machine (not shown in the figure) are received on the receiving table 27 as aligned in a row. Each of the film rolls R . . . rolls down on the inclined receiving table 27 to be received in the trough 7. The alignment-detecting arms 29 are laid down on the film rolls R . . . in the trough 7 and serve to detect correct alignment of the rolls R . . . in the trough 7. Then the alignment-detecting arms 29 are swung up and the electric motor 15 is energized to slide the cylindrical drum 13 rightwardly on FIG. 1 by means of the wheeled cart 14 to the position indicated by the chain lines in the figure so that the open end 19 thereof becomes engaged with the open end 22 of the base shaft 4. The supporting rod 20 held on the end plate 18 of the cylindrical drum 13 is accordingly inserted into the cardboard-made core tubes of the film rolls R . . . aligned in a row so that the film rolls R . . . are secured on the supporting rod 20 with stability. With the electric motor 15 interrupted, the open end 19 of the cylindrical drum 13 and the open end 22 of the base shaft 4 are air-tightly contacted and fastened together by operating the lock-ring cylinder device 23.

In the next place, the air-supply and evacuating mechanism built in the base shaft 4 is switched to work for air supply and the cylindrical drum 13 is pressurized by introducing compressed air through the air supply duct 5. The cylindrical drum 13 is maintained for a while or, usually, 20 to 40 seconds in this pressurized state so that each of the film rolls R is compacted by the air pressure and air bubbles entrained between layers of the rolled film are squeezed out. After lapse of the time, the air-supply and evacuating mechanism built in the base shaft 4 is switched to work for evacuation to discharge the air inside the cylindrical drum 13 out of the evacuation duct 6. When discharge of the air has been completed, the lock-ring cylinder device 23 is released and the open end 19 of the cylindrical drum 13 is disengaged from the open end 22 of the base shaft 4. Then, the electric motor 15 is energized to rotate in the reverse direction so as to slide the cylindrical drum 13 on the wheeled cart 14 leftwardly on FIG. 1.

Figure 3:
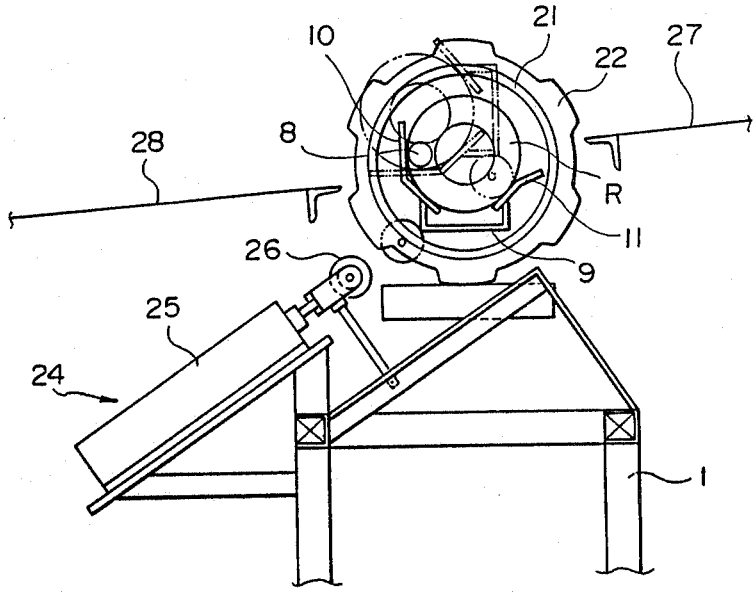
FIG. 3 is an illustration of the mechanism for tilting the trough.

When the cylindrical drum 13 thus slided has reached the starting position indicated by the solid lines on FIG. 1, the tilting mechanism 24 is operated so that the trough 7 is tilted by 90° around the axis 8 as being pushed by the advancing movement of the wheeled pusher rod 26 to reach the tilted position indicated by the chain lines on FIG. 3. As a consequence of the tilting movement of the trough 7, the film rolls R . . . on the trough 7 are each released on to the inclined discharge table 28 and roll down thereon to be received by a suitable transferring means such as a belt conveyor (not shown in the figure) to be transferred to a working station for packaging and shipping.

The tilting mechanism 24 of the trough 7 is again operated so as to bring the trough 7 to the starting untilted position where the trough 7 is ready to receive another set of film rolls for the next run of the compacting treatment. By repeating the above described cycle of the movement of each part, numbers of film rolls can be treated very efficiently to be imparted with greatly improved appearance without cloudiness.

It is of course that the above described sequence of the movements of the respective parts in the inventive apparatus can be readily and fully automatized by utilizing a conventional system for sequence control involving various mechanical control devices using cams and the like, electric control devices using electromagnetic relays, timers and the like, electronic sequence controllers using logic sequence circuits with semiconductor devices and computer programs, and so on. Therefore, the efficiency of the inventive apparatus can be improved so much in accordance with the extent of the automatization to give a great advantage to the industry of plastic film manufacture.

The above described compacting apparatus of the invention is applicable to a rolled film of any plastic resins having transparency without particular limitations. The treatment by use of the inventive apparatus gives particularly satisfactory results when the plastic resin is a plasticized polyvinyl chloride or the like resin, which may be colored or uncolored, including homopolymeric polyvinyl chloride resins, polyvinylidene chloride resins, chlorinated polyvinyl chloride resins, copolymeric resins of vinyl chloride and vinyl acetate and the like compounded with a substantial amount, e.g., 10 to 300 parts by weight or, preferably, 40 to 100 parts by weight per 100 parts by weight of the resin, of a plasticizer. The plastic film should have a thickness of 5 to 30 μm although there is no reason that the apparatus is not applicable to a plastic films having a smaller thickness than above.

Following is an example to show the cloudiness-reducing effect when a plastic film roll is treated in the inventive apparatus. As the standard conditions for the pneumatic compacting of film rolls in the inventive apparatus, the compacting air pressure is usually in the range from 5 to 20 $kg/cm^2G$ or, preferably from 5.0 to 6.0 $kg/cm^2G$ at a temperature of 20° to 40° C. and the length of time for compacting is 30 to 50 seconds although the length of this time depends on the pneumatic pressure and the desired degree of cloudiness reduction assuming that the temperature is the same. The cloudiness of a film roll can be visually inspected by holding the film roll to the illuminating light from a 40 watts fluorescent lamp 1.5 meters above the roll and looking through the roll. When the light is reflected in a mirror-like manner on the surface area of the roll smaller than 7% of the whole surface, which percentage is taken as a measure of the cloudiness, the film roll is acceptable as being substantially free from cloudiness.

EXAMPLE

A plasticized polyvinyl chloride resin composition was prepared by compounding 100 parts by weight of a homopolymeric polyvinyl chloride resin having an average degree of polymerization of about 1300, 15 parts by weight of a plasticizer (D610A, a product by Kyowa Hakko Co.) and 10 parts by weight of an epoxidated soybean oil. The resin composition was shaped into a film of 17 μm thickness by T-die extrusion at 200° C. and the film was wound on paper cores of 3 inches diameter into film rolls for film lengths of 500 meters, 1000 meters and 1500 meters. These film rolls were all very cloudy and not suitable for commercial purpose.

Pneumatic compacting treatment of these film rolls was performed using the inventive apparatus for 100 film rolls for each of the film lengths at 30° C. for 40 seconds under an air pressure of 5 kg/cm$^2$G to find that the cloudiness was 5% or smaller in all of the film rolls to be acceptable as a commercial product.

What is claimed is:

1. An apparatus for pneumatically compacting a roll of plastic films which comprises:

(a) a base stand having an elongated plan;

(b) a hollow cylindrical base shaft fixedly mounted in a horizontal disposition on or above the base stand along the longitudinal direction of the base stand and connected at one end to a means for air supply and evacuation, the other end being open;

(c) a trough for receiving rolls of plastic films pivotally connected to the base shaft at one end in a tiltable manner in the circumferential direction, the other end thereof extending toward the longitudinal direction of the base stand;

(d) an elongated cylindrical drum closed at one end remote from the base shaft and mounted above the base stand in a movable manner along the longitudinal direction of the base stand to envelope the trough when moved toward the base shaft; and (e) a means for fastening the open end of the elongated cylindrical drum to the open end of the base shaft and air-tightly connecting the same together.

* * * * *